United States Patent [19]

Stearley et al.

[11] Patent Number: 4,520,334

[45] Date of Patent: May 28, 1985

[54] PUSHBUTTON SWITCH WITH REMOTELY CONTROLLED OPERATING ATTACHMENT

[75] Inventors: John W. Stearley, Smithfield; Tony O. Woodard, Pine Level, both of N.C.

[73] Assignee: Eaton Corporation, Cleveland, Ohio

[21] Appl. No.: 546,704

[22] Filed: Oct. 28, 1983

[51] Int. Cl.[3] ..... H01H 3/02; H01H 45/02

[52] U.S. Cl. ..... 335/186; 335/164

[58] Field of Search ..... 335/186, 164, 165, 166

[56] References Cited

U.S. PATENT DOCUMENTS

| | | | |
|---|---|---|---|
| 3,153,124 | 10/1964 | Bury | 335/186 |
| 3,526,863 | 9/1970 | Vogelsang | 335/186 |
| 3,675,166 | 7/1972 | McCloskey et al. | 335/164 |
| 4,167,716 | 9/1979 | Horn | 335/14 |
| 4,305,054 | 12/1981 | Woodard | 335/164 |
| 4,383,149 | 5/1983 | Fulton | 200/68 |

*Primary Examiner*—Harold Broome

*Attorney, Agent, or Firm*—C. H. Grace; L. G. Vande Zande

[57] ABSTRACT

A solenoid (28) is mounted to a frame (26) secured to panel mounting clips (24) of a pushbutton switch for snap-on attachment to the switch housing (2). The switch has a hollow central chamber and a hole (32) is formed in the lower end (6) adjacent the solenoid (28) whereby an operator cap (10) may be removed and a headed coupling rod (34) inserted through the hollow chamber of the switch to project out the hole (32) for connection to the solenoid plunger (**28*b*). The operator cap (10) is subsequently replaced to permit manual operation of the switch or remote operation wherein the solenoid (28) is energized to pull the pushbutton operator (4**) to a depressed position.

16 Claims, 4 Drawing Figures

PUSHBUTTON SWITCH WITH REMOTELY CONTROLLED OPERATING ATTACHMENT

BACKGROUND OF THE INVENTION

Manufacturers of electric switches are frequently faced with a requirement to provide remote operating capabilities to an existing line of manually operated switches. It is preferable that the aesthetic and manual operating features of the existing switch be carried through in the remotely operable version. The quantity requirements for switches having remote operating capabilities are customarily too small to economically justify a major redesign or substantial retooling of the existing switch to incorporate this capability. Thus, it is preferable to achieve such additional capability by means of an auxiliary attachment device which can be incorporated with little or no modification to the existing switch.

SUMMARY OF THE INVENTION

This invention provides an existing pushbutton switch with an auxiliary attachment for providing remotely controlled operation of the switch. The pushbutton switch may have a momentary operation or may be of the push-push type wherein the button is latched in a first depressed position and is released by a subsequent depression of the pusbutton. The pushbutton switch is arranged to have a substantially hollow central chamber which, in an alternative embodiment, provides space for an indicating lamp. The remotely controlled operating attachment includes an electromagnetically operated device which is attached to the exterior of the switch housing. A hole is provided in the switch housing adjacent the auxiliary attachment to communicate with the hollow central chamber of the switch. A coupling member is provided to extend through that hole for connection with the pushbutton operator within the switch and the movable armature of the electromagnetic device of the attachment. Energization of the electromagnetic device causes depression of the pushbutton through the coupling linkage. The depression of the pushbutton may be such as to cause it to operate the switch from the extended position and move to its latched position or may be such as to move it from the latched position to a released position. The invention and its advantages will become more apparent in the following description and claims when read in conjunction with the accompanying drawings.

DESCRIPTION OF THE PREFERRED EMBODIMENT

The pushbutton switch utilized in this invention is of the type disclosed and claimed in U.S. Pat. No. 4,383,149 issued May 10, 1983 to Edward Fulton and assigned to the assignee of this application, the disclosure of which is incorporated herein by reference.

Figure 1:
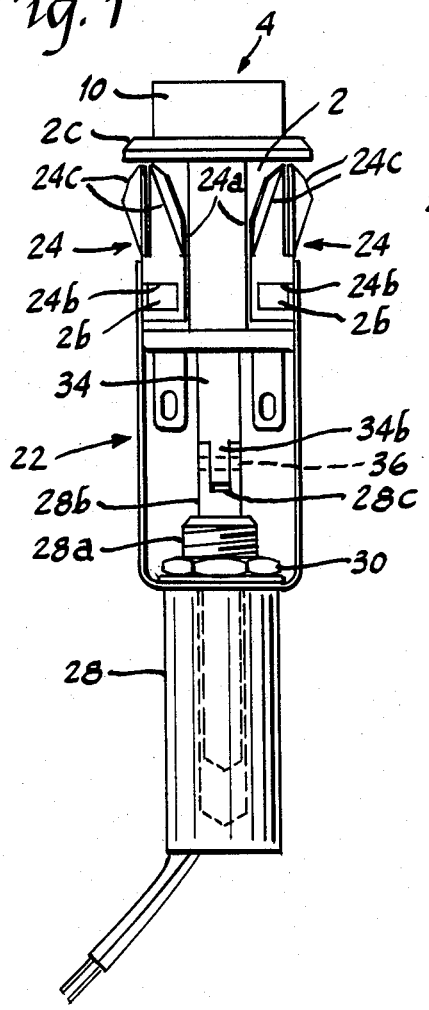
FIG. 1 is a side elevation view of a pushbutton switch with a remotely controlled electromagnetic operating attachment assembled thereto in accordance with this invention.
Figure 2:
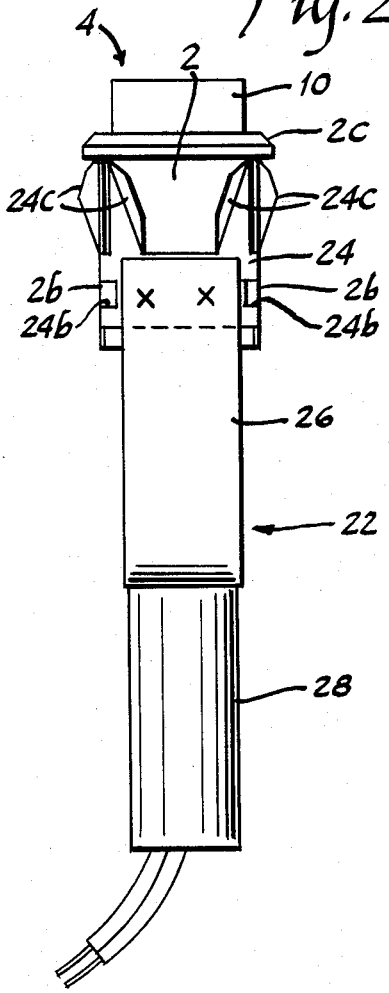
FIG. 2 is a right-hand view of the switch and auxiliary attachment of FIG. 1.
Figure 3:
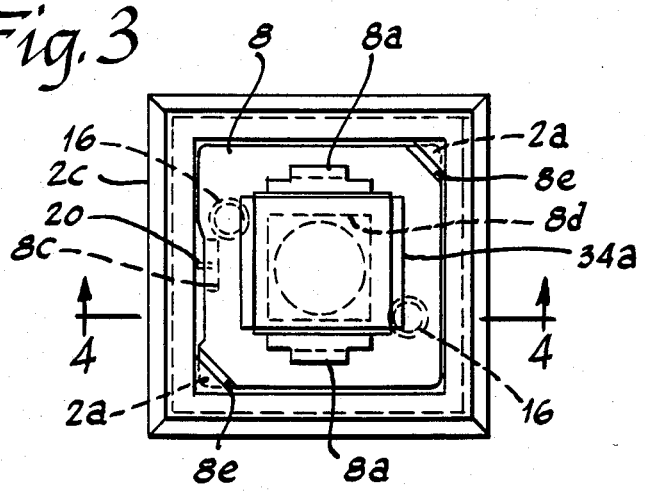
FIG. 3 is a top plan view of the switch of FIGS. 1 and 2 with a pushbutton operator cap removed therefrom.
Figure 4:
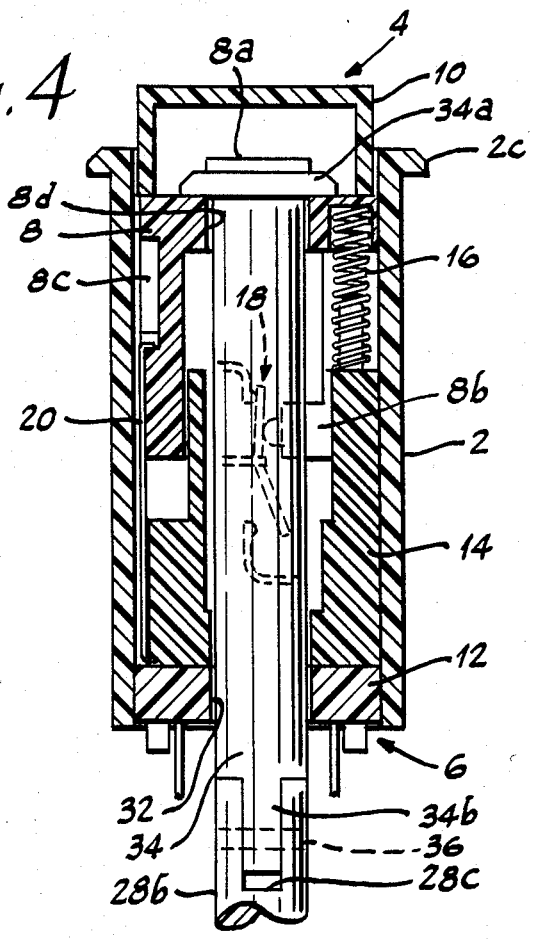
FIG. 4 is a cross sectional view of the switch taken along the line 4—4 of FIG. 3.

The switch comprises a hollow insulating housing 2 which has a pushbutton operator assembly 4 mounted for reciprocal movement in the upper end thereof and a switch base member 6 firmly secured in the lower end thereof. The transverse configuration of the switch is essentially square as seen in FIG. 3. The operator assembly 4 comprises a molded insulating platform operator 8 which is essentially square in plan view as seen in FIG. 3 and a hollow pushbutton cap 10 which is snap-fit attached to the platform 8 by upstanding resilient hooks 8*a* (FIG. 3) which engage with suitable indentures formed on the inside surfaces of an opposed pair of sidewalls of the cap 10. The base 6 is a two part assembly comprising a header 12 and a terminal support block 14 attached thereto. This assembly is secured within the lower end of the housing 2 by a snap-fit construction or by an adhesive or the like. A pair of springs 16 (only one of which is visible in FIG. 4) extend between the platform 8 and the terminal support member 14 to bias the operator assembly 4 to its extended position with respect to housing 2. A pair of corner fillets 2*a* in housing 2 are engaged by shoulders 8*e* on the corresponding corners of platform 8 (FIG. 3) to limit outward movement of the operator assembly 4, thereby defining the extended position for the operator assembly. The switch assembly contains two pairs of rocking contactor contact mechanisms 18, only one of which is shown in dotted lines in FIG. 4. The operator platform 8 has a pair of depending actuator legs 8*b* which carry spring loaded plungers into engagement with the rocking contactor of the respective contact mechanism to actuate the contacts as the pushbutton operator 4 is depressed. A "latched-on" wire 20 may be provided as shown along the left-hand side of the switch as viewed in FIG. 4 to provide a sequential push-push operation for the switch, latching the switch operator 4 in the depressed position upon an initial depression and releasing the operator upon a subsequent depression. The upper end of wire 26 is formed over to engage a cam groove 8*c* provided in the operator platform 8 for such purpose. The details of the cam groove for this purpose are well known in the switch art and have not been specifically illustrated herein. Without wire 20 the pushbutton switch will function as a momentary switch, the operator 4 being returned to its extended position by springs 16 upon release of manual pressure on the operator 4.

The contact assemblies 18, return springs 16, and the configuration of the terminal support member 14 and the operator platform 8 are arranged so as to provide an essentially hollow or open central chamber within the switch wherein a lamp assembly may be incorporated in an alternative embodiment of the switch to provide an illuminated or an indicating pushbutton switch. To this end, the operator 8 is provided with a rectangular central aperture 8*d*.

The switch has a pair of U-shaped clips 24 attached to the exterior of housing 2 for mounting the switch within a rectangular opening formed in the panel. Each clip 24 is disposed against one side of a pair of opposite sides of housing 2 and has end portions 24*a* which wrap around the adjacent corners of the housing. Openings 24*b* are provided in the end portions 24*a* to engage protruding bosses 2*b* formed on the exterior of the housing for retaining clips 24 attached to housing 2 with a snap-fit. Clips 24 are provided with a plurality of outwardly flared ears 24*c* for engaging the edges of the panel opening, the ears cooperating with an internally formed flange or bezel 2*c* on housing 2 to mount the switch to that panel in a well known manner.

To provide the aforedescribed switch with the capability of being remotely operated, an auxiliary operating attachment 22 is provided. The attachment 22 comprises a U-shaped frame 26 which is spot welded at the upper ends of the legs thereof to the respective U-shaped mounting clips 24. An electromagnetic device such as a solenoid 28 has a threaded bushing 28*a* projecting from one end thereof. Bushing 28*a* extends through an opening in the bight of frame 26 and is attached to the frame by a nut 30 which threadably engages with the threaded bushing 28*a*. Solenoid 28 has a plunger 28*b* loosely disposed for axial movement within a central opening to project out of the bushing end of the solenoid. The projecting end of plunger 28*b* is provided with a slot 28*c* for connection with a coupling member as will be described hereinafter. The attachment 22 with clips 24 welded to frame 26 is snap-fit attached to housing 2 in the same manner as clips 24 would be attached if frame 26 were not welded thereto.

In order to modify the switch to accept solenoid attachment 22, it is necessary only to form a hole 32 through the base 6 to communicate with the central chamber. By removing the lens cap 10 from the platform 8 of the operator assembly 4, the aperture 8*d* in operator platform 8 is exposed to the exterior of the switch. The aperture 8*d* communicates with the open central chamber of the switch assembly. An insulating rod 34 having a rectangular headed end 34*a* is inserted from the upper end of the switch through the aperture 8*d*, the open central chamber and the hole 32 to project out the lower end of the switch. The headed end 34*a* of the rod overlies the flat shouldered portion of the platform 8 adjacent aperture 8*d* and nests between the tabs 8*a* formed on the upper surface of platform 8. The lower end of rod 34 is provided with a depending tongue 34*b* which is inserted within the slot 28*c* of plunger 28*b*. The solenoid plunger 28*b* and the rod 34 are coupled together by a pin 36 which extends through transversely formed holes in the plunger 28*b* and the tongue 34*b* of rod 34. Lens cap 10*a* may be reattached to platform 8 of the operator 4 by snapping it into place.

In the normal extended position of the operator 4, rod 34 holds the plunger 28*b* up from its seated position within the solenoid 28. Energization of solenoid 28 from a remote location causes the latter to attract plunger 28*b* within the coil, thereby pulling down on the operator 4 through the coupling rod 34 connection between the operator and plunger. When the operator 4 is in the extended position, attraction of the solenoid plunger 28*b* will cause the operator to be depressed sufficiently to actuate the contact assembly 18. When utilized with the "latched-on" version of the switch, such solenoid driven movement of the operator will also move the operator 4 to a position whereby the spring 20 engages the respective portion of the cam surface 8*c* to latch the operator in its depressed position. A subsequent energization of the solenoid will cause the rod 34 to depress the operator 4 sufficiently to release the latch assembly, permitting the operator 4 to return to its extended position under the bias of springs 16 upon deenergization of the solenoid.

It will be appreciated that the rod 34 forms a relatively loose coupling connection with the operator platform 8 to thereby permit free movement of the operator 4 uninhibited by the plunger without necessitating the incorporation of precision guides or the like in the switch. The switch may therefore be manually operated without interference from the remote operation attachment.

Although the invention has been described herein in connection with a single preferred embodiment, it is to be understood that it is susceptible of various modifications without departing from the scope of the appended claims.

We claim:

1. An electric switch comprising, in combination:

a switch housing;

switch contact means in said housing;

pushbutton operator means movably mounted to said housing;

means biasing said pushbutton operator means to a first position;

said pushbutton operator means being manually depressible to a second position for actuating said switch contact means and for operating a latch means for latching said pushbutton operator means in said second position, said pushbutton operator means being manually depressible from said second position for releasing said latch means to permit said biasing means to return said pushbutton operator means to said first position, thereby deactuating said switch contact means;

an opening in said switch housing;

auxiliary means mounted proximate said housing for effecting depression of said pushbutton operator means in response to a control signal, comprising:

electromagnetic means fixedly positioned with respect to said housing and having armature means movable in response to energization of said electromagnetic means by said control signal; and coupling means extending through said opening having connection with said pushbutton operator means and said armature means.

2. The invention defined in claim 1 wherein said armature means moves freely with said pushbutton operator means when said electromagnetic means is deenergized to permit unrestricted manual operation of said switch.

3. The invention defined in claim 1 wherein said pushbutton operator means comprises a central aperture having adjacent shoulder surfaces and said coupling means comprises a rod extending from said armature means through said aperture in said pushbutton operator means and having lateral projections engaging said shoulder surfaces for effecting said connection with said pushbutton operator means.

4. The invention defined in claim 1 wherein said electromagnetic means is energizable to effect depression of said pushbutton operator means from said second position for releasing said latch means.

5. The invention defined in claim 4 wherein deenergization of said electromagnetic means releases said armature means for movement with said pushbutton operator means to said first position thereof by said biasing means.

6. The invention defined in claim 1 wherein:

said pushbutton operator means comprises a platform portion having a central aperture extending therethrough in the direction of axial movement thereof, laterally extending shoulder surfaces adjacent said aperture, and a cap removably attached to said platform portion and overlying said central aperture;

said switch contact means, said biasing means and said latch means are disposed to define a central axially extending open chamber within said switch communicating with said aperture at one end and said opening in said housing at an opposite end; and said coupling means comprises a rod insertable through said central aperture when said cap is removed to project through said central chamber and said opening in said housing, said rod having a flanged end abutting said shoulder surfaces.

7. The invention defined in claim 6 wherein said cap attached to said platform portion overlies said flanged end for retaining said rod assembled to said pushbutton operator means.

8. The invention defined in claim 6 wherein said connection of said coupling means and said armature means comprises a pinned connection between said rod and said armature means made externally of said switch housing.

9. The invention defined in claim 8 wherein said electromagnetic means comprises a solenoid and said armature means comprises an axially reciprocal plunger of said solenoid.

10. The invention defined in claim 1 wherein said auxiliary attachment means comprises a frame mounted to said housing and said electromagnetic means is mounted to said frame.

11. An electric switch comprising, in combination:

a switch housing;

switch contacts in said housing;

manually depressible pushbutton operator means movably mounted to said housing for effecting actuation of said contacts between first and second contact positions;

means biasing said operator means to a first position;

said operator means being depressible to a second position for moving said switch contacts to said second position and for engaging a latch means for retaining said operator means in said second position, said operator means being depressible in said second position for disengaging said latch means to permit said biasing means to move said operator means to said first position, thereby to move said contacts to said first position;

an opening in said switch housing;

electromagnetic means fixedly positioned proximate said housing and having means reciprocally movable in the direction of movement of said operator means in response to energization of said electromagnetic means; and coupling means extending through said opening having connection with said reciprocally movable means and said operator means;

wherein energization of said electromagnetic means effects depression of said operator means.

12. The invention defined in claim 11 wherein said reciprocally movable means is guided for unrestrained reciprocal movement with said operator means when said electromagnetic means is deenergized.

13. The invention defined in claim 11 wherein said operator means comprises an aperture extending in the direction of movement of said operator means and having an enlarged portion providing lateral shoulders in said aperture, and said coupling means extends through said aperture and has an enlarged end for engaging said shoulders to effect said connection with said operator means.

14. The invention defined in claim 13 wherein said enlarged end of said coupling means loosely rests upon said shoulders for effecting a uni-directional connection with said operator means operable to move said operator means from said first position to said second position.

15. The invention defined in claim 14 wherein said operator means further comprises a cap removably attached to said operator means, said cap being removable to permit insertion of said coupling means through said aperture in said operator means, and trapping said enlarged end of said coupling means to said operator means when attached to said operator means.

16. The invention defined in claim 11 wherein said electromagnetic means comprises a frame attached to said switch housing and a solenoid coil mounted to said frame externally of said switch housing.

* * * * *